US012693103B2

(12) United States Patent
Veksler et al.

(10) Patent No.: US 12,693,103 B2
(45) Date of Patent: Jul. 28, 2026

(54) ASSEMBLY, CONTAINER AND SYSTEM FOR STORING AND TRANSPORTING EXPLOSIVE DEVICES

(71) Applicant: IMI SYSTEMS LTD., Ramat Hasharon (IL)

(72) Inventors: Isar Veksler, Ramat Hasharon (IL); Liat Artzi Grushkevitz, Ramat Hasharon (IL)

(73) Assignee: IMI SYSTEMS LTD., Ramat Hasharon (IL)

( * ) Notice: Subject to any disclaimer, the term of this patent is extended or adjusted under 35 U.S.C. 154(b) by 15 days.

(21) Appl. No.: 17/872,759

(22) Filed: Jul. 25, 2022

(65) Prior Publication Data

US 2023/0058469 A1 Feb. 23, 2023

(30) Foreign Application Priority Data

Aug. 19, 2021 (IL) ..... 285749

(51) Int. Cl.
*F42B 39/30* (2006.01)
*B65D 81/113* (2006.01)
*F42B 39/24* (2006.01)

(52) U.S. Cl.
CPC ..... *F42B 39/24* (2013.01); *B65D 81/113* (2013.01)

(58) Field of Classification Search
CPC ..... F42B 39/30; F42B 39/24; F42B 39/14; F42B 39/26; B65D 85/34; B65D 85/32; B65D 85/321; B65D 85/322; B65D 85/324; B65D 81/113; B65D 81/133
See application file for complete search history.

(56) References Cited

U.S. PATENT DOCUMENTS 3,204,848 A * 9/1965 Olson ..... B65D 85/324 206/521.1
3,598,300 A * 8/1971 Katz ..... B65D 85/324 217/26.5
3,853,221 A * 12/1974 Boyd ..... B65D 1/36 206/592
4,173,286 A * 11/1979 Stanko ..... B65D 81/022 220/4.24

(Continued)

FOREIGN PATENT DOCUMENTS

DE 2346145 A1 * 3/1975
DE 10222344 C1 9/2003

(Continued)

OTHER PUBLICATIONS

"Notice before Acceptance and search report mailed by IL patent office on Feb. 10, 2022 for IL priority application 285749".

*Primary Examiner* — Allan D Stevens
(74) *Attorney, Agent, or Firm* — The Roy Gross Law Firm, LLC; Roy D. Gross

(57) ABSTRACT

Embodiments pertain to a protective packaging assembly configured to be placed within a container and for receiving a plurality of explosive devices, the protecting packaging assembly comprising: a protective holder unit comprising: a plurality of receiving spaces which are arranged at different heights relative to each other with respect to a reference plane. The plurality of receiving spaces may have a mating profile that matches a profile portion of at least one of the plurality of the explosive devices to be placed in the plurality of receiving spaces.

19 Claims, 8 Drawing Sheets

(56) References Cited

U.S. PATENT DOCUMENTS

| | | | | | |
|---|---|---|---|---|---|
| 4,195,743 | A * | 4/1980 | Emery | B65D 1/36 | 206/521.1 |
| 5,158,173 | A | 10/1992 | Halsey et al. | | |
| 6,123,200 | A * | 9/2000 | Stephens | B65D 81/133 | 206/592 |
| 6,732,865 | B2 * | 5/2004 | Mostini | B65D 1/36 | 206/521.1 |
| 6,865,977 | B1 | 3/2005 | Kim et al. | | |
| 7,395,922 | B1 * | 7/2008 | Sinha | F42B 39/24 | 206/593 |
| 9,470,484 | B2 | 10/2016 | Benson | | |
| 2003/0146128 | A1 * | 8/2003 | Sakai | B65D 81/025 | 206/583 |
| 2017/0176158 | A1 | 6/2017 | Cirillo | | |

FOREIGN PATENT DOCUMENTS

| | | | | |
|---|---|---|---|---|
| EP | 1637830 | B1 | 7/2009 | |
| FR | 2490203 | A1 * | 3/1982 | |
| GB | 1187806 | A * | 4/1970 | |
| JP | 5584031 | B2 | 9/2014 | |
| JP | 6399815 | B2 | 10/2018 | |
| KR | 20190140230 | A | 12/2019 | |
| WO | WO-2015078922 | A1 * | 6/2015 | B65D 1/36 |

* cited by examiner

View E-E

ASSEMBLY, CONTAINER AND SYSTEM FOR STORING AND TRANSPORTING EXPLOSIVE DEVICES

CROSS-REFERENCE TO RELATED APPLICATIONS

This application claims priority to Israel Patent Application 285749, filed Aug. 19, 2022, and which is incorporated herein by reference in its entirety.

FIELD OF THE INVENTION

The disclosure relates to explosives in general, and to a system for storing and transporting explosive devices, in particular.

BACKGROUND

Safely storing and transporting explosives is challenging. There are challenges which are common to all storage and transportation tasks. The challenges include but are not limited to compact packaging, aimed at reducing the volume and thereby the storage and transportation costs and complexity; lightweight but durable packaging for protecting the packaged items; and options for comfortable and easy handling and carrying by humans.

In addition, there are challenges which are unique to explosives, and particularly grenades. A first problem is the need to mitigate the detonation risk. Moreover, in case one device accidentally detonates, it is required to reduce the risk of causing a chain effect of detonations of further devices contained in a container.

A further challenge may relate to the ease and speed of removing items from a container. Since explosives are generally used in combats and training, where a fraction of a second may be crucial, the packaging needs to allow for fast and safe removal of items from the container.

BRIEF DESCRIPTION OF THE DRAWINGS

The figures illustrate generally, by way of example, but not by way of limitation, various embodiments discussed in the present document.

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. References to previously presented elements are implied without necessarily further citing the drawing or description in which they appear. The number of elements shown in the Figures should by no means be construed as limiting and is for illustrative purposes only. The figures are listed below.

DETAILED DESCRIPTION

Figure 1:
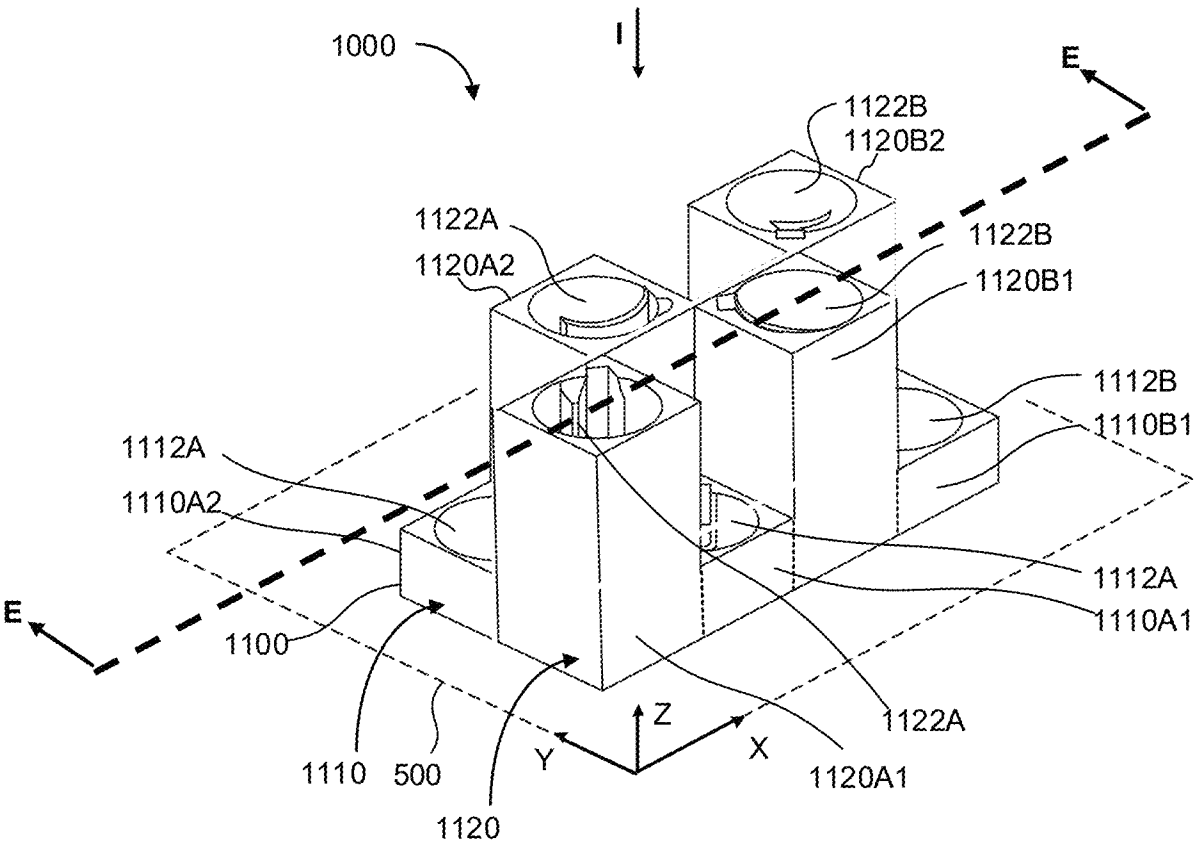
FIG. 1 is a schematic illustration of a protective holder unit, according to some embodiments.

The disclosure relates to embodiments of a transport system for objects capable of detonation. The transport system comprises a container and an internal protective packaging assembly for storing and transporting explosive devices in general such as, for example, hand grenades. Embodiments also pertain to a method for manufacturing and a transport system and/or internal protective packaging assembly.

In some examples, the protective packaging assembly is configured to facilitate and to provide compact and efficient explosives packaging and is further configured to facilitate comparatively easy and safe handling of containers configured to receive such protective packaging arrangement.

In some embodiments, the protective packaging assembly is configured to mitigate the risk of the detonation of explosive devices stored within the container, and moreover the risk of such detonation causing detonations of additional devices.

Moreover, a protective packaging assembly in accordance with embodiments of the present disclosure allows fast and easy access to all packaged devices, such that they can be removed and used without undue delay. Embodiments thus pertain to a protective packaging assembly that can be received by a container of a transporting system. The protective packaging assembly may comprise a protective holder unit and a protective cover unit. The protective holder unit and the protective cover unit are configured to be, e.g., form-fittingly and, optionally, frictionally insertable into the container.

In some embodiments, the protective holder unit is configured to receive a plurality of explosive devices such as grenades. The protecting holder may comprise a holder body structure having a plurality of cavities formed therein in the body structure to create a corresponding plurality of explosive device holders.

In some embodiments, the protective device comprises a plurality of pillars including a plurality of respective receiving spaces which are arranged at different heights relative to a common virtual reference plane and which, in some examples, may have a mating profile that matches a profile portion of at least one of the plurality of the explosive devices to be placed in the receiving spaces. The plurality of pillars include a first pillar and a second pillar. The at least two pillars, viewed from the top, have a polygonal cross-section.

In some examples, a container bottom wall may define the common virtual reference plane.

In some examples, the protective holder unit comprises a plurality of pillars having at least two different heights with respect to the common virtual reference plane.

In some examples, any two neighboring pillars may be of different height.

In some examples, the pillars may be arranged in an ortholinear array having substantially vertical columns and horizontal rows.

In some examples, any two neighboring pillars along a vertical column may be of different height. In some examples, any two neighboring pillars along a horizontal row may be of different height.

In some examples the pillars may be arranged in a non-ortholinear (e.g., staggered) array such as, for example, in a beehive geometry.

Each pillar may include a receiving space or cavity having a mating profile that matches a profile portion of at least one of the plurality of the explosive devices to be placed in the receiving space.

In some embodiments, the geometry of the cavities may be configured to snug-fit receive one explosive device per holder.

For example, a receiving space or cavity may be formed in the holder body. The receiving space may have a seating profile that matches the form of a portion of the explosive device that can be received in the receiving space.

In some examples, the profile is configured to form-fittingly engage with either a bottom portion or an upper portion of an explosive device partially inserted into the cavity, to protrude out of the cavity. In some other embodiments, at least some of the cavities may not be adapted to form-fittingly receive a bottom portion or an upper portion of an explosive device inserted into the cavity. In some examples, the cavity may be a through-hole cavity.

In some examples, the "form-fitting receiving" of an explosive device by a cavity may pertain to inhibiting lateral movement of the explosive devices in a plane that is perpendicular to an insertion or placement direction, when the device is operably received in the seating to complementary engage the seating's mating profile.

In some examples, the "form-fitting receiving" of an explosive device by a cavity may pertain to inhibiting rotational movement of the explosive devices in a plane that is perpendicular to an insertion direction, when the device is operably received in the seating to complementary engage the seating's mating profile.

In some examples, the "form-fitting receiving" of an explosive device by a cavity may pertain, when operably received to complementary engage the mating profile, to inhibiting five degrees of movement and/or rotation, except for a removal for a degree of freedom to allow insertion of explosive devices in the direction I extending along a longitudinal cavity axis.

In some embodiments, the cavity geometry may be configured to form-fittingly receive an explosive device such to prevent axial rotation of the device around its insertion axis, once the explosive device is (e.g., partially) received by the cavity to complementary engage the mating profile.

Accordingly, in some examples, at least some of the cavities may be shaped to receive an explosive device in a particular orientation and position relative to a neighboring explosive device. For example, two neighboring cavities may be configured to form-fittingly receive the two respective explosive devices in an alternating upright and inverted (also: reversed or upside-down) orientation.

In some embodiments, the protective holder unit may be configured such that when neighboring explosive devices are operably positioned within the cavities of the protective holder unit, the portions of the explosive devices containing the bulk or all the explosive material are, in ortholinear direction, non-overlapping or, at most, partially overlapping. For example, a first and second cavity of two neighboring cavities may be configured such that the explosive portion of a first device operably arranged in the first cavity is distally located from the explosive portion of the second device operably arranged in the second cavity.

For instance, each two neighboring cavities of the protective holder unit may be arranged in an alternating low-high height configuration along the explosive insertion direction, relative to a virtual reference plane that is perpendicular to the insertion directions. For example, the bottom of the first cavity may be elevated relative to the bottoms of each neighboring second cavity. This way, the risk of a chain effect as result of unintentional detonation of a single explosive device may be reduced.

In some embodiments, an explosive device may be at least partially received in a frictional manner by an arrangement's cavity. For instance, a cavity may comprise padding material to facilitate frictionally holding explosives within the cavities of the protective holder unit.

In some embodiments, the protective holder unit may be made of various material including, for example, foam, polyurethan, closed-cell extruded polystyrene, and/or any other material which may be comparatively soft.

Although the disclosure herein may relate to hand grenades each having a safety catch, it will be appreciated that the disclosure is applicable also to storing and transporting various other types of ammunition.

Although the illustrations discussed herein show pillars having only two different heights, this should by no means construed in a limiting manner. Accordingly, pillars of three of more heights may be employed.

Figure 2B:
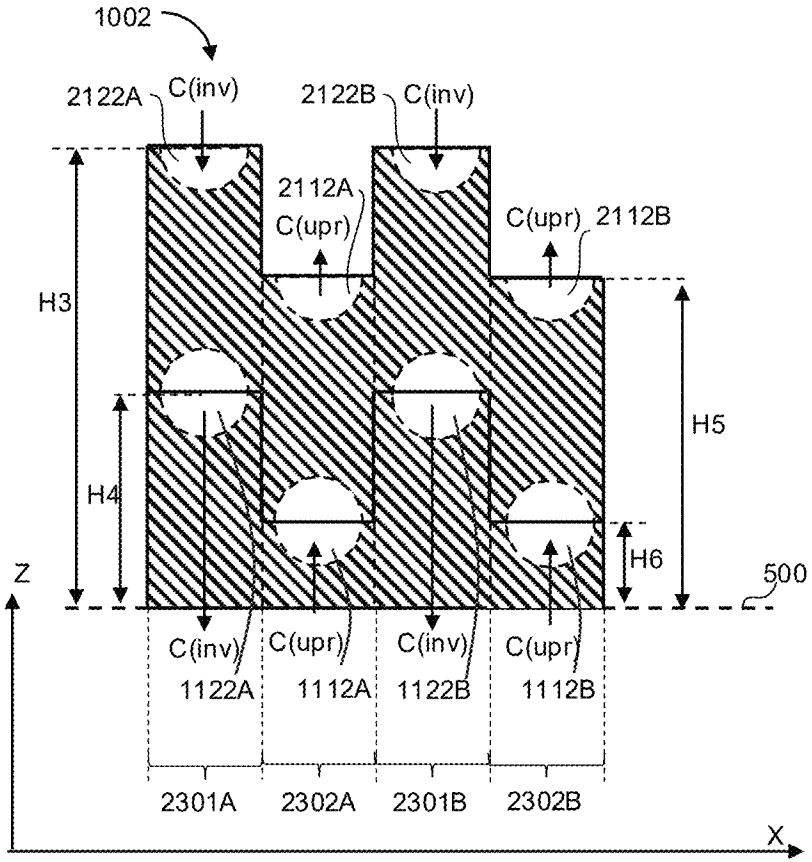
FIG. 2B is a schematic cross-sectional sideview illustration of a protective holder unit, according to some other embodiments.
Figure 2A:
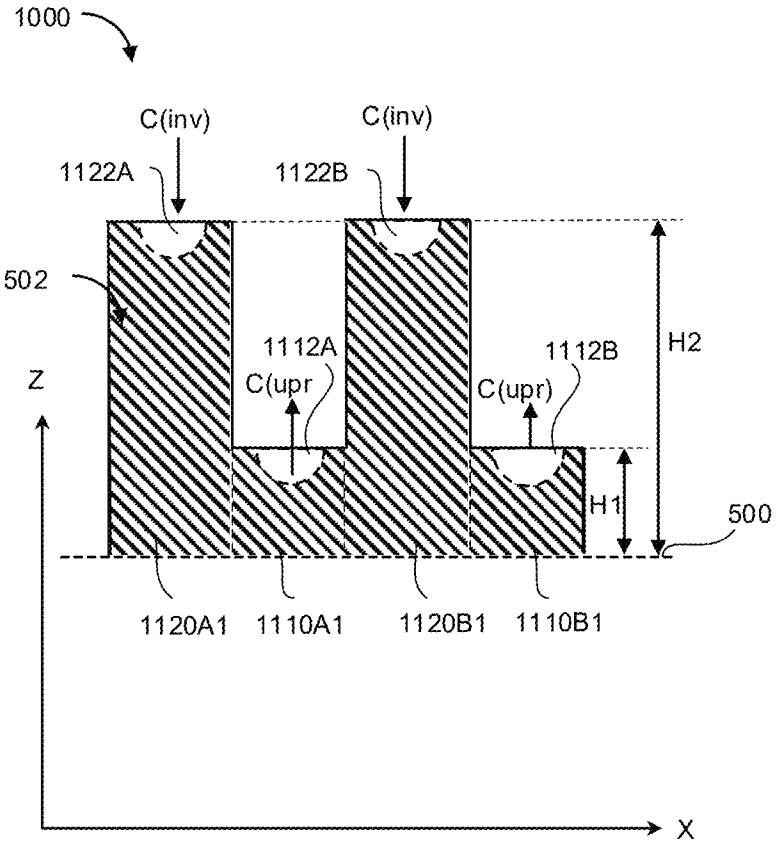
FIG. 2A is a schematic cross-sectional sideview illustration taken along line E-E of the protective holder unit of FIG. 1.

Referring now FIGS. 1 and 2A, a protective holder unit 1000 has a body or support structure 1100 comprising an arrangement of pillars 1110 and 1120 having different heights to obtain an (e.g., alternating) arrangement of short pillars 1110 and long pillars 1120 which may extend in direction of elevation axis Z from a common virtual reference plane 500 which is virtually spanned by x-y axes. Optionally, the virtual reference plane 500 may be defined (e.g., coincide) with the container bottom wall. In some examples, long pillars 1120 may be arranged to extend from a virtual reference plane of body structure to form interstitial spaces constituting the corresponding short pillars 1110.

FIG. 2A schematically shows a sectional view of protective holder unit 1000 at section plane 502 (viewed from direction E-E shown in FIG. 1). Section plane 502 is schematically shown as being viewed from viewing direction D, which is exemplified as being parallel to reference to plane 500 in Y-direction.

In the examples illustrated herein, short pillars arranged in a first row along axis X are designated by reference numerals 1110A1, 1110B1, etc. where the numbering "1" indicates the row number. Hence, in the example shown in FIG. 2A, body structure 1100 comprises a matrix arrangement of pillars having alternating height relative to virtual reference plane 500 and includes a first row of long pillar 1120A1, short pillar 1110A1, long pillar 1120B1 and short pillar 1110B1; and further a second row of columns having alternating height including short pillar 1110A2, long pillar 1120A2, another short pillar (obscured by long pillar 1120B1) and long pillar 1120B2. The dashed vertical lines extending in Z-direction are shown to schematically delineate the virtual boundaries between neighboring pillars.

It is noted that a terms or expressions such as "neighboring pillar" or "adjacent pillar" pertains to the nearest neighbor pillar, thereby excluding, in a rectangular row-column matrix arrangement of pillars or seatings, diagonal or next-nearest pillar elements.

It is noted that the pillars are configured such to delineate alternating short-long pillars of different heights relative to reference plane 500 in any selected row direction. Accordingly, as exemplified in FIGS. 1 and 2A, the pillars are arranged such to have an alternating height arrangement along the Y-direction, with respect to their pillar heights in direction Z. In some embodiments, a side wall of short pillars 1110 may be partially common to a side wall of long pillars 1120.

It is noted that although embodiments are discussed herein with respect to an arrangement of pillars having alternating height with respect to a rectangular row-column matrix configuration, this should by no means construed in a limiting manger. Accordingly, the alternating-height pillar arrangement may also be applicable for non-rectangular pillar arrangements.

The plurality of short pillars 1110 and long pillars 1120 may each comprise a corresponding short pillar cavity and long pillar cavity such that the protective holder unit 1000 includes an alternating arrangement of lower cavities (also: lower receiving spaces) 1112 and higher cavities (also: higher receiving spaces) 1122, with respect to reference plane 500, extending in X-direction and Y-direction. The bottom of a higher receiving space may be above the entry level o a neighboring lower receiving space.

A lower cavity may herein also be referred to as "short pillar cavity" or "short pillar receiving space"; and a higher cavity may herein also be referred to "high pillar receiving space".

Accordingly, in some examples, a lower cavity 1112 only has higher cavities 1122 as its nearest neighbors, and vice versa.

In some embodiments, each lower cavity 1112 and higher cavity 1122 may be configured to form-fittingly receive an explosive device. In some examples, the form-fitting coupling may pertain to maximal five degrees of freedom, except for a removal or insertion direction I, which extends along a reverse direction as elevation axis Z. In some examples, the cavities may be configured to frictionally couple the explosive device with respect to the insertion direction I. For example, each one of the cavities may have a cavity geometry which is slightly smaller in dimension than the explosive designed to be received in the cavity. The cavity may be padded with a comparatively soft and rough material to attain a certain degree of frictional coupling between the surface of the cavity and a corresponding surface portion of the explosive device engaging with the surface of the cavity.

In some embodiments, a protective holder unit may comprise a plurality of sets of stacked cavities that are arranged relative to each other in a staggered arrangement. For example, as is schematically shown in FIG. 2B, a protective holder unit 1002 may comprise a first higher top cavity 2122A that may be arranged above a first lower top cavity 1122A, forming a first higher stack of cavities 2301A.

A first higher bottom cavity 2112A may be arranged above a first lower bottom cavity 1112A, forming a first lower stack of cavities 2302A.

A second higher top cavity 2122B may be arranged above a second lower top cavity 1122B, forming a second higher stack of cavities 2301B, and a second higher bottom cavity 2112B may be arranged above a second lower bottom cavity 1112B, forming a second lower stack of cavities 2302B.

Viewed along axis X, first lower top cavity 1122A may be arranged at a height H4 relative to reference plane 500 such to be disposed between first higher bottom cavity 2112A and first lower bottom cavity 1112A. In addition, first higher bottom cavity 2112A may be arranged at a height relative to reference plane 500 such to be disposed between first lower top cavity 1122A and first higher top cavity 2122A.

Viewed along axis X, first higher bottom cavity 2112A may be arranged at a height relative to reference plane 500 such to be disposed between first lower top cavity 1122A and first higher top cavity 2122A.

Viewed along axis X, second lower top cavity 1122B may be arranged at a height H4 relative to reference plane 500 such to be disposed between second lower top cavity 2112B and second lower bottom cavity 1112B. In addition, second higher bottom cavity 2112B may be arranged at a height relative to reference plane 500 such to be disposed between second lower top cavity 1122B and second higher top cavity 2122B.

In some examples, as schematically shown in FIGS. 2A, lower cavities 1112A and 1112B may be arranged at an about equal first height H1 above reference plane 500, and first lower bottom cavity 1112A and second lower bottom cavity 1112B may be arranged at an about equal second height H2 above reference plane 500, higher than the first height.

In some examples, as schematically shown in FIG. 2B, first higher top cavity 2122A and second higher top cavity 2122B may be arranged at an about equal height H3 above reference plane 500, and first higher bottom cavity 2112A and second higher bottom cavity 2112B may be arranged at an about equal height H5 above reference plane 500, where H5<H3.

In some examples, as schematically shown in FIG. 2B, first lower top cavity 1122A and second lower top cavity 1122B may be arranged at an about equal height H4 above reference plane 500, and first lower bottom cavity 1112A and second lower bottom cavity 1112B may be arranged at an about equal height H6 above reference plane 500, where H6<H4.

Protective holder unit illustrated in FIG. 2B is shown to have two cavities per stack. However, this should by no means be construed in a limiting manner. Accordingly, according to some embodiments protective holder units may generally comprise a plurality of stacks of cavities, each stack having a plurality of cavities.

In some example configurations, a protective holder may comprise a first and second stack, each stack comprising a higher top cavity and a higher bottom cavity, as shown in FIG. 2B, yet only a single cavity disposed between the higher top and higher bottom cavities.

Hence, with reference to FIG. 2B, such protective holder unit may be configured to include first higher top cavity 2122A and first higher bottom cavity 2112A; and second higher top cavity 2122B and second higher bottom cavity 2112B, and first lower bottom cavity 1112A, as well as first lower top cavity 1122A and second lower top cavity 1122B. However, such protective holder unit may not comprise first lower bottom cavity 1112A and second lower bottom cavity 1112B. Clearly, additional or alternative staggered cavity configurations may be conceived.

Figure 3:
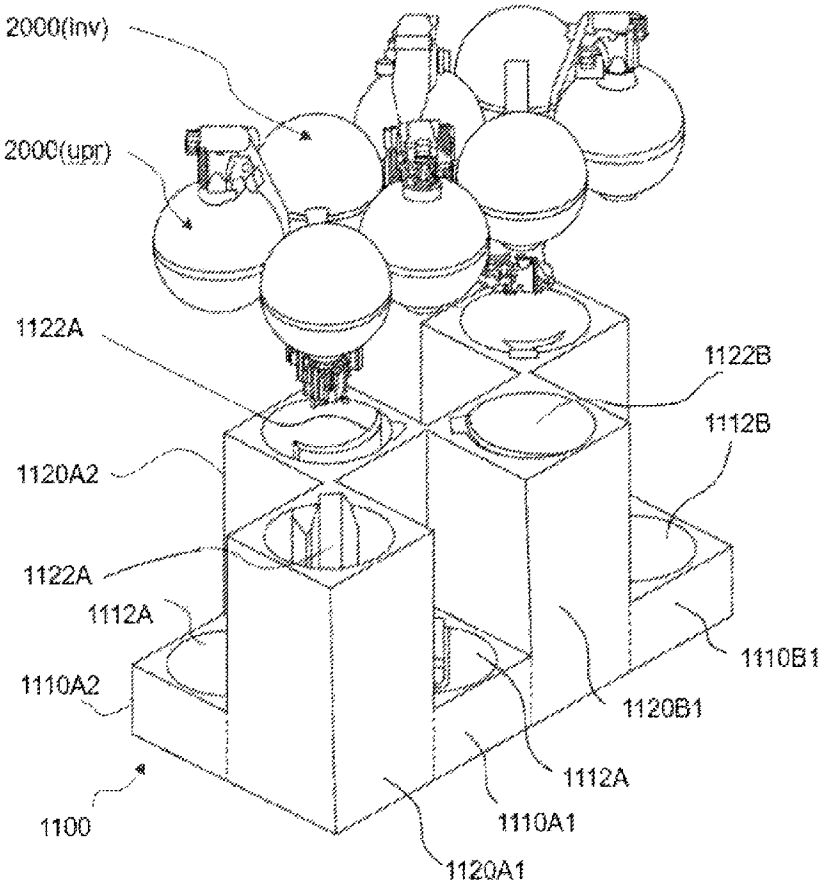
FIG. 3 is a schematic view of a protective holder unit and of explosive devices in alignment with receiving spaces of the protective holder unit, according to some embodiments.
Figure 4B:
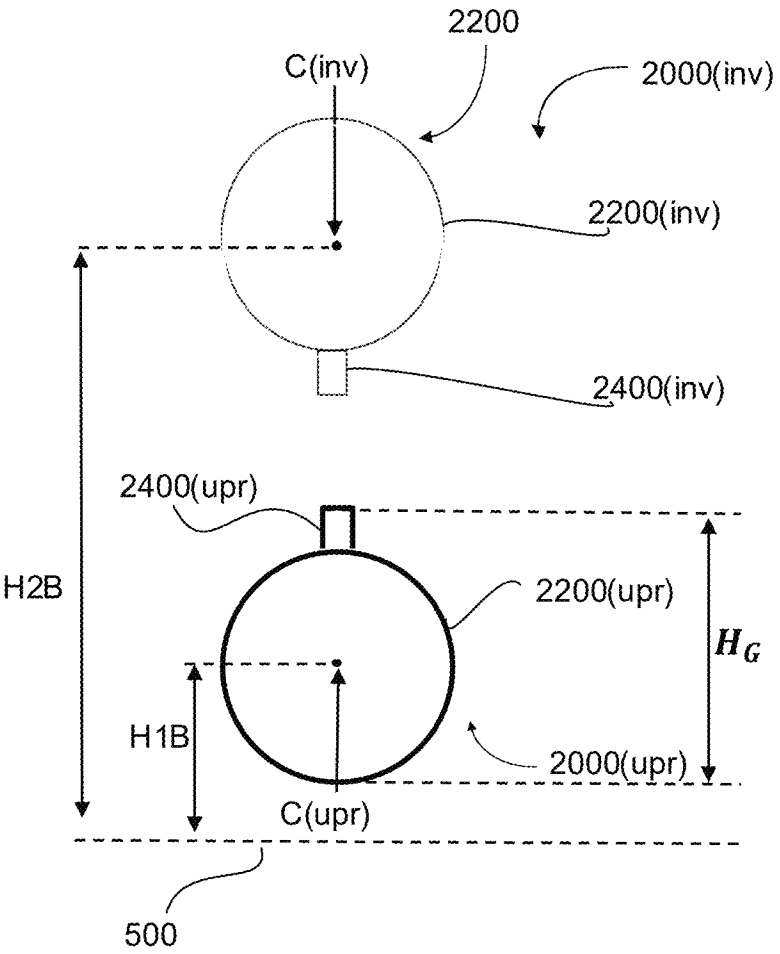
FIGS. 4A and 4B are schematic illustrations of the orientations and positions of explosive devices when arranged in a protective holder, according to some embodiments.
Figure 4A:
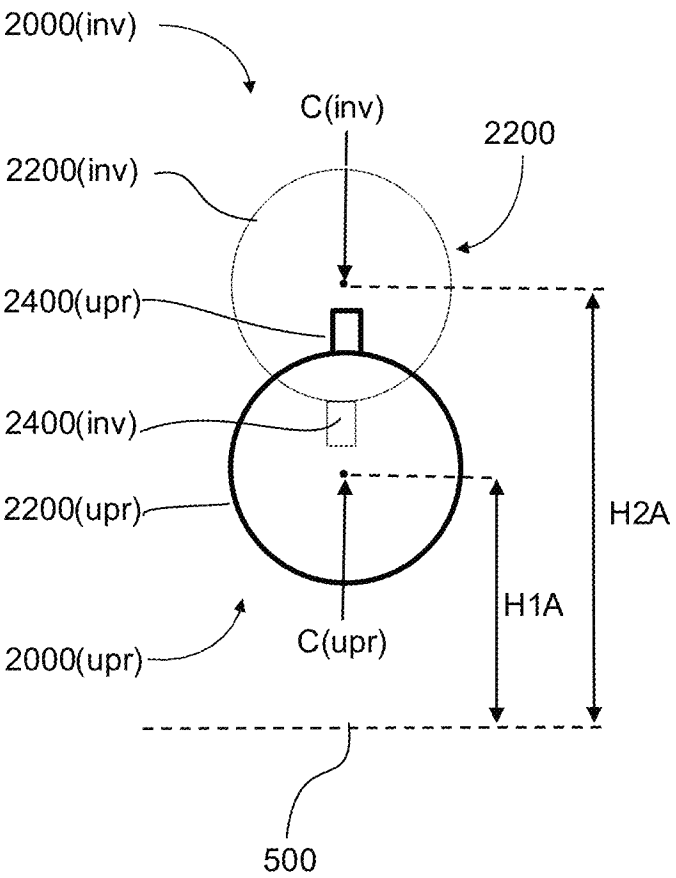

Reference is now made to FIG. 3 and further to FIGS. 4A and 4B. FIG. 3 is a schematic exploded view of the alternating upright and inverted orientation of grenades 2000 before there are placed in the corresponding lower cavities 1112 and higher cavities 1122. In the example shown, lower cavities 1112 may be configured to form-fittingly receive grenades 2000 only when they are in their upright orientation relative to the reference plane 500. Conversely, higher cavities 1122 may be configured to form-fittingly receive grenades 2000 only when the grenades are in their inverted position with respect to reference plane 500. Accordingly, the mating profiles of lower cavities 1112 may be different than mating profiles of higher cavities 1122 to correspond to the profiles of the devices 2000 when in upright orientation 2000(*upr*) and inverted orientation 2000(*inv*), respectively.

The height-alternating arrangement, and further the alternating upright and inverted form-fitting profile arrangements of the cavities, provides for distancing away the neighboring explosive body portions 2200(*upr*) and 2200(*inv*) from each other, thereby reducing the risk that detonation of one grenade will initiate a chain effect of detonation of neighboring ones, and so forth. Generally, explosive body portions 2200(*upr*) and 2200(*inv*) may herein be collectively referred to as explosive body portions 2200.

As shown with respect to reference plane 500 in FIGS. 4A and 4B, embodiments of projections of two neighboring grenades 2000(*upr*) and 2000(*inv*) are schematically shown relative to reference plane 500, where upright grenade 2000(*upr*) is positioned with its lever and safety catch 2400(*upr*) and explosive body portion 2200(*upr*) at the bottom, whereas inverted grenade 2000(*inv*) is positioned with its lever and safety catch 2400(*inv*) at the bottom and explosive body portion 2200(*inv*) at the top.

In such "distal arrangement", explosive body of grenade 2000(*upr*), when in upright orientation, is proximal to reference plane 500 compared to the position of lever and safety catch 2400(*upr*) of grenade 2000(*upr*). Conversely, explosive body portion 2200(*inv*) of inverted grenade 2000 (*inv*) is located distal from reference plane 500 compared to the position of lever and safety catch 2400(*inv*). Furthermore, the geometric center of the explosive body portion 2200(*upr*) of the grenade 2000(*upr*) in upright position C(upr) is closer to reference plane 500 than the geometric center of the explosive body portion 2200(*inv*) of the grenade 2000(*inv*) in the inverted position. In FIG. 4A, the upright position C(upr) relative to reference plane 500 is designated as H1A, and the inverted position of C(inv) is designated as H2A. In FIG. 4B, the upright position C(upr) relative to reference plane 500 is designated as H1B, and the inverted position of C(inv) is designated as H2B.

In the example of FIG. 4A, the explosive body portions 2200(*upr*) and 2200(*inv*) are shown as being partially overlapping when viewed from direction D. In the example of FIG. 4B, the explosive body portions 2200(*upr*) and 2200 (*inv*) are shown as being non-overlapping when viewed from viewing direction D.

The lower cavities 1112 are thus adapted to form-fittingly and, optionally, frictionally receive, the hand grenades 2000 such that explosive body portions are pointed downwards, and higher cavities 1122 are shaped to form-fittingly receive hand grenades 2000 with their explosive body portions pointed upwards relative to reference plane 500.

Although it is appreciated that maximizing distance between the explosive body portions of two neighboring grenades is preferred, the selected configuration depends on the available height of the container relative to the height of the grenades, e.g., distance HG as measured from the safety catch to the bottom of the grenade's explosive body portion.

Reverting to FIGS. 2A and 2B, example orientations of explosive devices are schematically illustrated by upright positions C(upr) indicating that the safety catch is above the explosive body, and by inverted positions C(inv), indicating that the safety catch is below the explosive body, relative to reference plane 500. It is noted that different arrangements of explosive orientations may be conceived. For example, the cavities of protective holder unit 1002 may be designed to arrive at different orientations of the explosives than those presently shown in FIG. 2B to maximize the distance between explosive bodies seated in neighboring cavities of a same stack and/or juxtaposed stacks.

Figure 5:
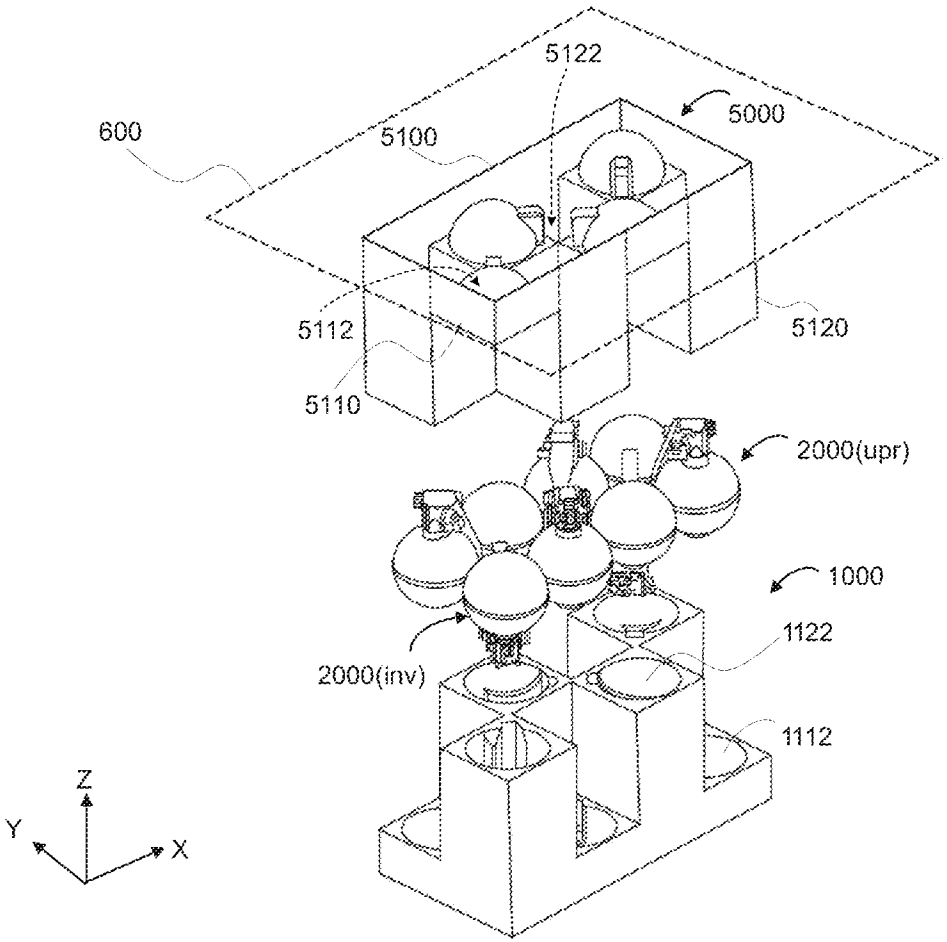
FIG. 5 is a schematic view of the protective holder unit and of the explosive devices, together with a corresponding protective cover unit, according to some embodiments.

Additional reference is now made to FIG. 5, In addition to protective holder unit 1000, a protective cover unit 5000 may be employed. Protective cover unit 5000 having a body structure 5100 may be adapted to be complementary placed over the grenades 2000 received in the cavities of protective holder unit 1000, to protect the grenades from colliding with the top of the container, or from falling out if the container overturns.

In some examples, in geometric correspondence with protective holder unit 1000, protective cover unit 5000 may comprise a plurality of higher cavities 5112 and lower cavities 5122. The higher cavities and lower cavities may have a profile that fits over a corresponding protruding portion of an explosive device 2000 seated in a receiving space.

In some examples, analogous to protective holder unit 1000, protective cover unit 5000 may comprise short pillars 5110 and long pillars 5120 which may extend along in reverse direction of elevation axis Z from a common upper reference plane 600. In some examples, long pillars 5120 may be arranged to extend from a base of body structure to form the corresponding short pillars 5110.

Short pillars 5110 and long pillars 5120 may be configured for complementing the heights of long pillars 1120 and short pillars 1110. For example, long pillars 5120 may constitute male protrusion that snug-fit into recesses formed between the long pillars 5120, wherein the recesses may constitute the short pillars 5110.

With respect to reference plane 500, short pillars 5110 may have, with respect to reference plane 500, higher cavities 5112 configured to (e.g., form- and/or snug-) fit over a corresponding portion of inverted explosive device 2000 (*inv*) seated in or received by the corresponding higher cavity 1122, and long pillars 5120 may have lower cavities 5122 configured to (e.g., form- and/or snug-) fit over a corresponding portion of upright explosive device 2000 (*upr*) seated in lower cavity 1112.

In some embodiments, protective cover unit 5000 may contain corresponding higher cavities 5112 of short pillar 5110, and lower cavities 5122 of long pillars 5120, with respect to reference plane 500.

In some embodiments, protective cover unit 5000 may have an identical configuration as protective holder unit 1000, including the internal pattern of each cavity, such that it is not required to manufacture two different types of layers, such that the holder unit and the cover unit are functionally interchangeable.

In some embodiments, the number of short and long pillars in protective holder unit 1000 may be identical to the number of short and long pillars of protective cover unit 5000. For example, a container containing 2*4 grenades is suitable for such design and may provide for a container that may be carried by a single person.

Figure 6:
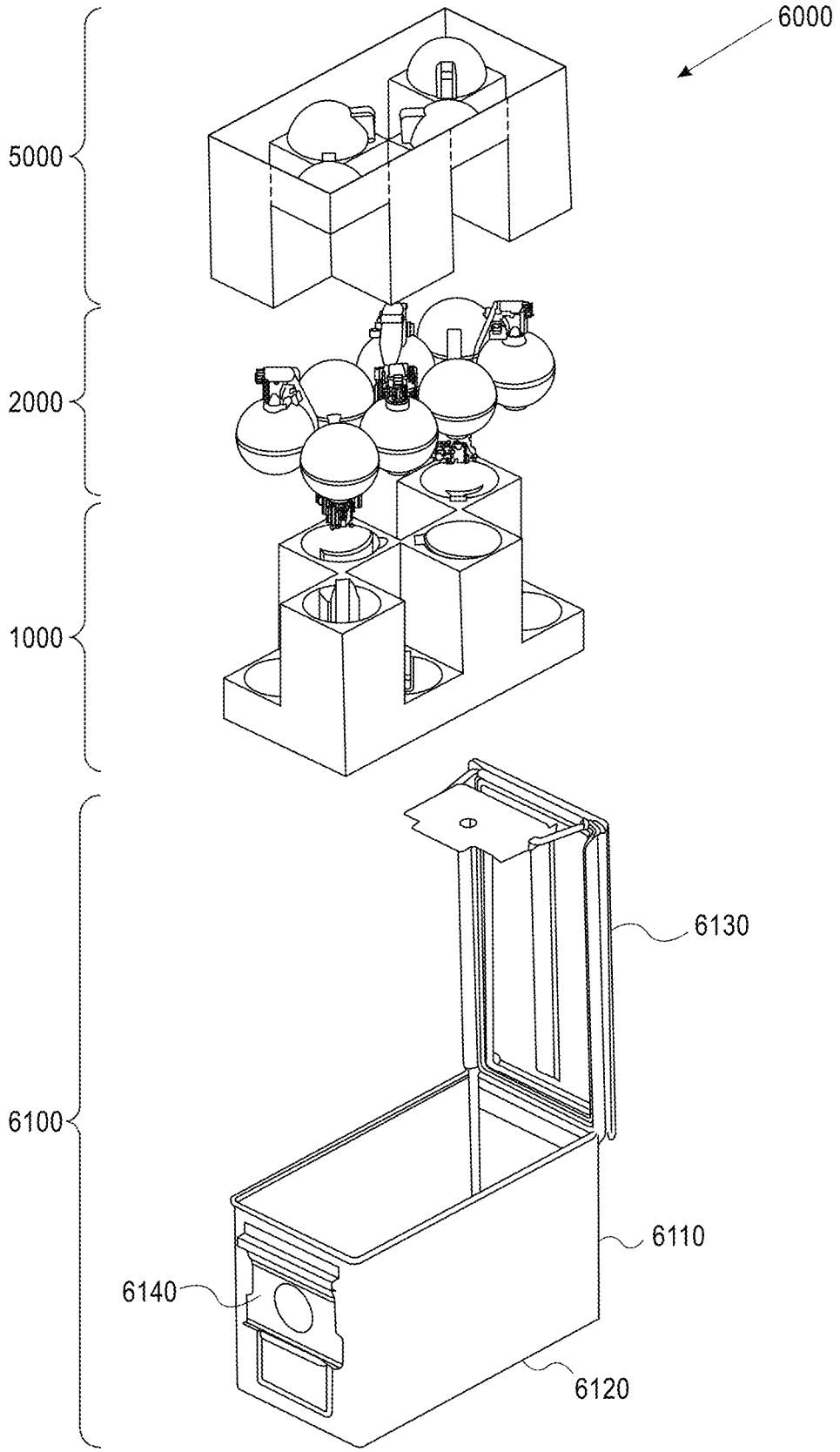
FIG. 6 is an exploded view of a transport system, according to some embodiments.

Reference is now made to FIG. 6, schematically showing an exploded view of transport system 6000 comprising a container 6100 and the protective packaging assembly including protective holder unit 1000 and protective cover unit 5000, in conjunction with grenades 2000.

It is noted that grenades 2000 may not considered part of transport system 6000.

Container 6100 comprises four side walls 6110 and a bottom wall 6120, a container cover 6130 and optionally at least one handle 6140, for carrying the transport system 6000. In some examples, bottom wall 6120 may constitute and/or define reference plane 500. Container 6100 may be suitable to receive protective holder unit 1000 which may be placed on the bottom of container 6100, grenades 2000 and protective cover unit 5000.

Container 6100 may then be closed using cover 6130 and may be carried using handle 6140 and another handle placed on its rear end (not shown), or another carrying mechanism. Container 6100 may be designed such that its height is such that cover 6130 closes tightly onto protective cover unit 5000 without leaving a space therebetween.

Container 6100 may be made of any sturdy durable material such as, for example, wood or metal.

Figure 7A:
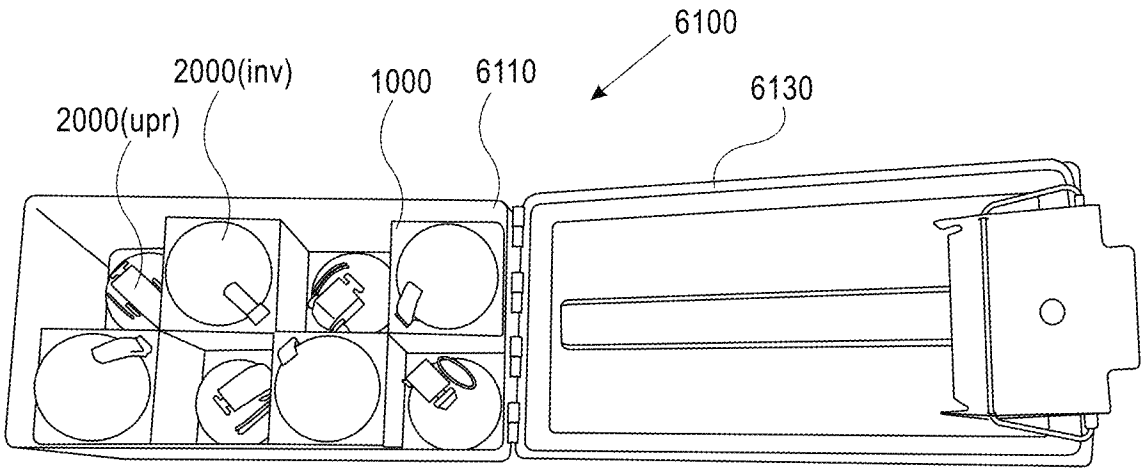
FIG. 7A depicts an image of a transport system including a protective holder unit and explosive devices received by the protective holder unit, according to some embodiments.

FIG. 7A shows an image of a top view of transport system 6000 with the cover 6130 removed from container 6100, protective holder unit 1000 and grenades 2000(*upr*) and 2000(*inv*), before protective cover unit 5000 is placed on top of the grenades 2000.

Figure 7B:
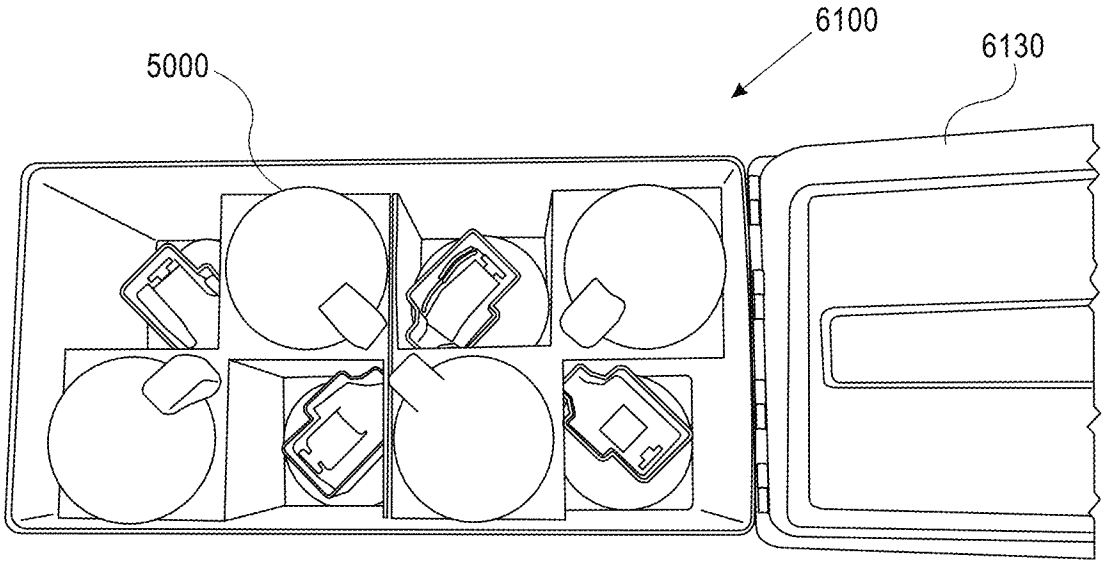
FIG. 7B depicts an image of the transport system along with a protective cover unit placed over the protective holder unit, according to some embodiments.

FIG. 7B shows an image of a top view of transport system 6000 with cover 6130 removed, and with protective cover unit 5000 covering the grenades 2000. The container 6100 is ready to be closed for transportation, wherein the grenades are stably positioned.

It will be appreciated that two or more protective packaging assemblies may be placed into (e.g., stacked on one another) the same container.

In some examples, fill packaging material may be added to facilitate fixating the protective packaging assembly in place within container 6100.

The disclosed structure provides for storing and carrying objects and in particular explosive objects such as hand grenades in a safe manner. The storage arrangement mitigates the detonation risk of each single explosive device, and also reduces the risk of causing a chain effect of detonations of further devices in the container.

The disclosed structure provides for easy and comfortable removal of the grenades form the box, without further delays. Moreover, the removal is just as easy and comfortable if the box is turned upside down.

Figure 8:
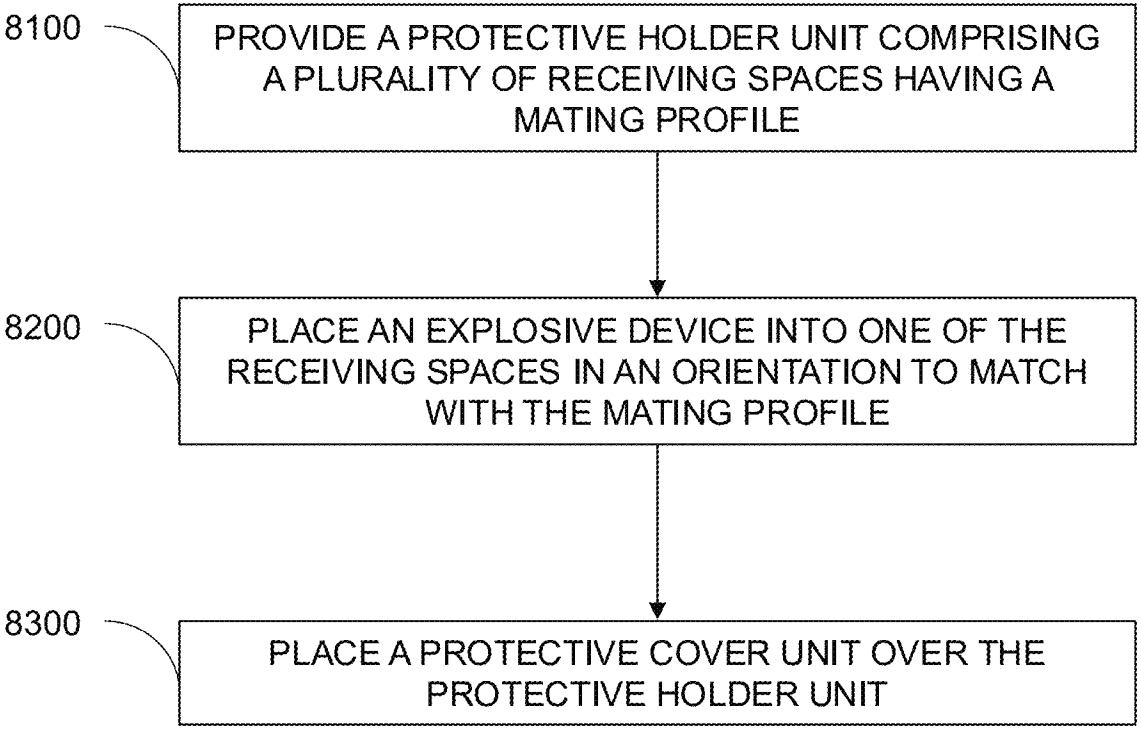
FIG. 8 is a schematic flow chart illustration of a method for assembling an assembly for transporting explosive devices.

Additional reference is made to FIG. 8. In some embodiments, a method may include providing a protective holder unit comprising a plurality of receiving spaces having a mating profile (block 8100).

In some embodiments, the method may further include placing an explosive device into one of the receiving spaces in an orientation to match with the mating profile (block 8200).

In some embodiments, the method may include placing a protective cover unit over the protective holder unit (block 8300).

ADDITIONAL EXAMPLES

Example 1 concerns a protective packaging assembly configured to be placed within a container and for receiving a plurality of explosive devices, the protecting packaging assembly comprising:

a protective holder unit comprising: a plurality of receiving spaces which are arranged at different heights relative to each other with respect to a reference plane, wherein the plurality of receiving spaces have a mating profile that matches a profile portion of at least one of the plurality of the explosive devices to be placed in the receiving spaces.

Example 2 includes the subject matter of Example 1 and, optionally, wherein at least one first receiving space of the plurality of receiving spaces has a first mating profile, and wherein at least one second receiving space of the plurality of receiving spaces has a second mating profile, different from the first mating profile.

Example 3 includes the subject matter of Example 2 and, optionally, wherein the at least one first receiving space is arranged at a first height relative to the reference plane, and; wherein the at least one second receiving space is arranged at a second height relative to the reference plane, different from the first height.

Example 4 includes the subject matter of examples 2 and/or 3 and, optionally, wherein the first mating profile of the at least one first receiving space matches a profile portion of the explosive device to be receivable in the at least one first receiving space in a first device orientation; and wherein the second mating profile of the at least one second receiving space matches a profile portion of the explosive device (2000) to be receivable in the at least one second receiving space in a second device orientation that is different from the first device orientation.

Example 5 includes the subject matter of Example 4 and, optionally, wherein the first device orientation is an upright orientation, and wherein the second device orientation is an inverted device orientation, relative to the reference plane.

Example 6 includes the subject matter of Example 5 and, optionally, wherein the first receiving space is a lower receiving space configured to receive the explosive device in the upright orientation; and wherein the second receiving space is a higher receiving space, relative to the reference plane and the first receiving space, and wherein the second receiving space is configured to receive the explosive device in the inverted orientation to obtain alternating upright and inverted arrangement of explosive devices when operably placed in the respective receiving spaces.

Example 7 includes the subject matter of Example 6 and, optionally, wherein the explosive devices are arranged such that an explosive body portion of an upright explosive device is proximal to the reference plane; wherein an explosive body portion of an inverted explosive device is distal from the reference plane and elevated relative to the explosive body portion of the upright explosive device.

Example 8 includes the subject matter of any one or more of the examples 1 to 8 and, optionally, wherein the plurality of receiving spaces are arranged in an ortholinear array comprising substantially vertical columns and horizontal rows.

Example 9 includes the subject matter of any one or more of the Examples 1 to 8 and, optionally, wherein the plurality of receiving spaces are arranged in a non-ortholinear manner.

Example 10 includes the subject matter of any one or more of the Examples 1 to 9 and, optionally, at least two pillars including the plurality of receiving spaces.

Example 11 includes the subject matter of any one or more of the examples 1 to 10 and, optionally, comprising a plurality of pillars, wherein each pillar comprises a receiving space Example 12 includes the subject matter of example 10 and, optionally, wherein each pillar comprises a respective receiving space.

Example 13 includes the subject matter of any one or more of the examples 10 to 12, and optionally, wherein the at least two pillars are arranged in an ortholinear array comprising substantially vertical columns and horizontal rows.

Example 14 includes the subject matter of any one or more of the examples 10 to 13 and, optionally, wherein the at least two pillars are arranged in a non-ortholinear manner.

Example 15 includes the subject matter of any one or more of the examples 10 to 13 and, optionally, wherein the at least two pillars comprise: a short pillar, optionally extending from the reference plane and including a lower receiving space; and a long pillar having a higher receiving space.

Example 16 includes the subject matter of any one or more of the examples 1 to 15 and, optionally, a protective cover unit comprising a plurality of higher cavities and lower cavities having profiles which fit over a corresponding protruding portion of explosive devices seated in receiving spaces.

Example 17 includes the subject matter of example 16 and, optionally, wherein the protective cover unit comprises covering pillars configured to snug-fit between recesses formed between the at least two pillars of the protective holder unit.

Example 18 includes the subject matter of examples 16 and/or 17 and, optionally, wherein the protective cover unit comprises a plurality of long pillars and short pillars; wherein the plurality of long pillars of the protective cover unit comprises a corresponding a plurality of lower cavities; and wherein the plurality of short pillars of the protective cover unit comprises a corresponding plurality of higher cavities;

wherein the lower cavities have seating profiles that match the surface profiles of an explosive body portion protruding out of the lower receiving spaces of the protective holder unit; and wherein the short pillar receiving spaces have seating profiles that match the surface profiles of explosive body portions protruding out of the long pillar receiving spaces of the protective holder unit.

Example 19 includes the subject matter of any one or more of the Example 1 to 18 and, optionally, wherein the protective holder unit comprises a plurality of receiving spaces in a stacked configuration.

Example 20 pertains to a system for transporting explosives, comprising: a container having a bottom wall; four side walls configured to define a container cavity, and a cover configured to selectively cover and uncover the container cavity; and a protective packaging assembly according to any one or more of the examples 1 to 19, wherein the protective packaging assembly is configured such to be placeable in a snug-fit manner into the container cavity.

In the description and claims of the application, each of the words "comprise" "include" and "have", and forms thereof, are not necessarily limited to members in a list with which the words may be associated. In addition, where there are inconsistencies between this application and any document incorporated by reference, it is hereby intended that the present application controls.

The various features and steps discussed above, as well as other known equivalents for each such feature or step, can be mixed and matched by one of ordinary skill in this art to perform methods in accordance with principles described herein. Although the disclosure has been provided in the context of certain embodiments and examples, it will be understood by those skilled in the art that the disclosure extends beyond the specifically described embodiments to other alternative embodiments and/or uses and obvious modifications and equivalents thereof. Accordingly, the disclosure is not intended to be limited by the specific disclosures of embodiments herein.

In the discussion, unless otherwise stated, adjectives such as "substantially" and "about" that modify a condition or relationship characteristic of a feature or features of an embodiment of the invention, are to be understood to mean that the condition or characteristic is defined to within tolerances that are acceptable for operation of the embodiment for an application for which it is intended.

Unless otherwise specified, the terms 'about' and/or 'close' with respect to a magnitude or a numerical value may imply to be within an inclusive range of −10% to +10% of the respective magnitude or value.

Unless otherwise specified, the terms 'about' or 'close' imply at or in a region of, or close to a location or a part of an object relative to other parts or regions of the object.

What is claimed is:

1. A protective packaging assembly configured to be placed within a container and for receiving a plurality of explosive devices comprising explosive body portions for reducing the risk of causing a chain effect of detonation by unintentional detonation of one of the plurality of explosive devices receivable by the packaging assembly, the protective packaging assembly comprising:

a protective holder unit comprising:

a plurality of explosive device receiving spaces which are ortholinearly arranged and comprise openings that are at alternating different heights relative to each other with respect to a reference plane for distancing away from each other, wherein the plurality of openings of the explosive device receiving spaces are configured to receive ortholinearly neighboring explosive body portions of the plurality of explosive devices such that in a row and column direction the explosive body portions of the explosive devices are configured to be partially overlapping or non-overlapping;

wherein the protective holder unit further comprises at least four pillars that include the plurality of explosive device receiving spaces;

wherein a first pillar of the at least four pillars extends from the reference plane and includes a lower receiving space;

wherein a second pillar of the at least four pillars comprises a higher receiving space and wherein the length of the second pillar exceeds the length of the first pillar;

a protective cover unit comprising a plurality of higher cavities and a plurality of lower cavities having profiles configured to fit over a corresponding protruding portion of explosive devices when seated in a receiving space;

wherein the protective cover unit comprises covering pillars configured to snug-fit between recesses formed between two neighboring pillars each comprising a higher receiving space.

2. The protective packaging assembly of claim 1, wherein the plurality of receiving spaces each have a mating profile that matches a profile portion of at least one of the plurality of the explosive devices that are configured to be receivable in the plurality of receiving spaces.

3. The protective packaging assembly of claim 1, wherein at least one first receiving space of the plurality of receiving spaces has a first mating profile, and wherein at least one second receiving space of the plurality of receiving spaces has a second mating profile, different from the first mating profile.

4. The protective packaging assembly of claim 3, wherein the at least one first receiving space is arranged at a first height relative to the reference plane, and;

wherein the at least one second receiving space is arranged at a second height relative to the reference plane, different from the first height.

5. The protective packaging assembly of claim 3, wherein the first mating profile of the at least one first receiving space is configured to match a profile portion of an explosive device that is configured to be receivable by the at least one first receiving space in a first device orientation; and wherein the second mating profile of the at least one second receiving space is configured to match a profile portion of the explosive device that is configured to be receivable by the at least one second receiving space in a second device orientation that is different from the first device orientation.

6. The protective packaging assembly of claim 5, wherein the first device orientation is an upright orientation, and wherein the second device orientation is an inverted device orientation, relative to the reference plane.

7. The protective packaging assembly of claim 6, wherein the first receiving space of the plurality of explosive device receiving spaces is the lower receiving space configured to receive the explosive device in the upright orientation; and wherein the second receiving space is the higher receiving space of the plurality of explosive device receiving spaces, relative to the reference plane and the first receiving space, and wherein the second receiving space is configured to receive the explosive device in the inverted orientation to obtain alternating upright and inverted arrangement of explosive devices when operably placed in the respective receiving spaces.

8. The protective packaging assembly of claim 7, wherein the plurality of explosive device receiving spaces are configured to receive explosive devices arranged such that an explosive body portion of an upright explosive device is proximal to the reference plane and such that an explosive body portion of an inverted explosive device is configured to be distal from the reference plane and elevated relative to the explosive body portion of the upright explosive device.

9. The protective packaging assembly of claim 1, wherein the at least four pillars each comprise a respective one of the receiving spaces.

10. The protective packaging assembly of claim 1, wherein the at least four pillars are arranged in an ortholinear array comprising vertical columns and horizontal rows.

11. The protective packaging assembly of claim 1, wherein the plurality of receiving spaces are in a stacked configuration.

12. A system for transporting explosives, comprising:

a container having a bottom wall; four side walls configured to define a container cavity, and a cover configured to selectively cover and uncover the container cavity; and the protective packaging assembly of claim 1, wherein the protective packaging assembly is configured such to be placeable in a snug-fit manner into the container cavity.

13. A protective packaging assembly configured to be placed within a container and for receiving a plurality of explosive devices comprising explosive body portions for reducing the risk of causing a chain effect of detonation by unintentional detonation of one of the plurality of explosive devices receivable by the packaging assembly, the protecting packaging assembly comprising:

a protective holder unit comprising:

a plurality of explosive device receiving spaces which are ortholinearly arranged and comprise openings that are at alternating different heights relative to each other with respect to a reference plane for distancing away from each other, wherein the plurality of openings of the explosive device receiving spaces are configured to receive ortholinearly neighboring explosive body portions of the plurality of explosive devices such that in a row and column direction the explosive body portions of the explosive devices are configured to be partially overlapping or non-overlapping;

wherein the protective holder unit comprises at least four pillars that include the plurality of explosive device receiving spaces;

wherein the at least four pillars, viewed from the top, have a polygonal cross-section, wherein a first pillar of the at least four pillars extends from the reference plane and includes a lower receiving space;

wherein a second pillar of the at least four pillars comprises a higher receiving space and wherein the length of the second pillar exceeds the length of the first pillar;

wherein a bottom of the higher receiving space is above an entry level of the lower receiving space.

14. The protective packaging assembly of claim 13, wherein the plurality of receiving spaces each have a mating profile that matches a profile portion of at least one of the plurality of the explosive devices that are configured to be receivable in the plurality of receiving spaces.

15. The protective packaging assembly of claim 13, wherein at least one first receiving space of the plurality of receiving spaces has a first mating profile, and wherein at least one second receiving space of the plurality of receiving spaces has a second mating profile, different from the first mating profile.

16. The protective packaging assembly of claim 15, wherein the at least one first receiving space is arranged at a first height relative to the reference plane, and;

wherein the at least one second receiving space is arranged at a second height relative to the reference plane, different from the first height.

17. The protective packaging assembly of claim 15, wherein the first mating profile of the at least one first receiving space is configured to match a profile portion of an explosive device that is configured to be receivable by the at least one first receiving space in a first device orientation; and wherein the second mating profile of the at least one second receiving space is configured to match a profile portion of the explosive device that is configured to be receivable by the at least one second receiving space in a second device orientation that is different from the first device orientation.

18. The protective packaging assembly of claim 17, wherein the first device orientation is an upright orientation, and wherein the second device orientation is an inverted device orientation, relative to the reference plane.

19. The protective packaging assembly of claim 13, wherein the at least four pillar are arranged in an ortholinear array comprising vertical columns and horizontal rows.

* * * * *